US010548394B2

(12) United States Patent
Castex et al.

(10) Patent No.: US 10,548,394 B2
(45) Date of Patent: Feb. 4, 2020

(54) COSMETIC APPLICATOR HAVING MOVABLE PROTUBERANCES

(71) Applicant: Chanel Parfums Beauté, Neuilly-sur-Seine (FR)

(72) Inventors: Nicolas Castex, Colombes (FR); Marc Lassus, Saverne (FR)

(73) Assignee: Chanel Parfums Beauté (FR)

( * ) Notice: Subject to any disclaimer, the term of this patent is extended or adjusted under 35 U.S.C. 154(b) by 0 days.

(21) Appl. No.: 15/746,555

(22) PCT Filed: Jul. 20, 2016

(86) PCT No.: PCT/FR2016/051872
§ 371 (c)(1),
(2) Date: Jan. 22, 2018

(87) PCT Pub. No.: WO2017/013358
PCT Pub. Date: Jan. 26, 2017

(65) Prior Publication Data

US 2018/0213924 A1 Aug. 2, 2018

(30) Foreign Application Priority Data

Jul. 21, 2015 (FR) ..... 15 56917

(51) Int. Cl.
*A46B 7/02* (2006.01)
*A46B 11/00* (2006.01)
*A46B 9/02* (2006.01)

(52) U.S. Cl.
CPC ..... *A46B 11/001* (2013.01); *A46B 9/021* (2013.01); *A46B 7/023* (2013.01); *A46B 7/026* (2013.01); *A46B 2200/1053* (2013.01)

(58) Field of Classification Search
CPC ..... A46B 7/023; A46B 7/026
USPC ..... 132/119, 121, 123
See application file for complete search history.

(56) References Cited

U.S. PATENT DOCUMENTS 4,473,086 A * 9/1984 Thaler ..... A45D 1/18 132/229
6,968,848 B2 * 11/2005 Grant ..... A45D 24/00 132/119
2004/0112398 A1 6/2004 Grant et al.

FOREIGN PATENT DOCUMENTS

WO 2008102992 A1 8/2008
WO 2010066748 A1 6/2010

* cited by examiner

*Primary Examiner* — David J Walczak
*Assistant Examiner* — Joshua R Wiljanen
(74) *Attorney, Agent, or Firm* — St. Onge Steward Johnston & Reens, LLC

(57) ABSTRACT

An applicator for applying an eyelash cosmetic including a body and protuberances having a free end and arranged so as to be movable relative to the body between a retracted position and an extended position, in which the protuberances extend outward from the body further than in the retracted position. The applicator is designed such that every free end moving from the retracted to the extended position follows a path that is transversal to a longitudinal axis of the applicator.

20 Claims, 10 Drawing Sheets

COSMETIC APPLICATOR HAVING MOVABLE PROTUBERANCES

FIELD OF THE INVENTION

The invention relates to cosmetic product applicators.

BACKGROUND OF THE INVENTION

Articles for the application of mascara comprising a mascara container and a cap to which a brush is securely attached are known. In the closed position, the brush is immersed in the container. During use, it is preferable to remove the excess mascara present on the brush bristles. The article therefore comprises a wiper at the container inlet.

Such articles have disadvantages.

The brush comes out of the container loaded with product, in particular at the base of the bristles and around the center of the brush. In practice, this product is of little use for making up the eyelashes. In addition, in contact with the air, it tends to dry on the brush, which could eventually impair the brush properties and reduce the lifetime of the article. We can see that the product concerned which is not used for make-up is thus wasted.

SUMMARY OF THE INVENTION

An object of the invention is therefore to control the quantity of product loaded on the applicator more precisely.

The invention therefore relates to an applicator for applying an eyelash cosmetic, which comprises:

a body, and protuberances having a free end and arranged so as to be movably mounted relative to the body between a retracted position and an extended position, in which the protuberances extend outward from the body further than in the retracted position.

the applicator being arranged such that each free end follows a path transverse to the longitudinal axis of the applicator from the retracted position to the extended position.

Thus, only the end portions of the protuberances are loaded with product. However, during make-up, it is this part of the protuberances which preferably comes into contact with the eyelashes. The aim is therefore to make sure that most of the product deposited on the applicator is actually used for make-up. This reduces waste. This also reduces the risk of the product drying on the brush and extends the lifetime of the brush.

The protuberances according to the invention must be understood as being protuberances to be used for make-up.

Moreover, one of the advantages of the protuberances being movable and in particular being able to extend inside the applicator body is that space is saved when the applicator is stored inside the article, thereby allowing the production of such articles with a small size.

The protuberances will for example be bristles, teeth, pins or other similar reliefs.

Each free end could follow a path substantially perpendicular to a longitudinal axis of the applicator.

The angle formed by the path and the longitudinal axis of the applicator is between 60° et 120°.

Advantageously, the applicator is arranged such that at least some of the protuberances extend fully into the body in the retracted position.

Again advantageously, the applicator is arranged such that all the protuberances extend fully into the body in the retracted position.

This further reduces the size of the applicator, especially when it is stored inside the article.

In one embodiment, the protuberances form groups of protuberances extending in a given plane perpendicular to the axis, the protuberances of each group being connected together by an internal end of the protuberances in the body.

The connection between the internal ends of the protuberances in a given group can be made in different ways. This connection can for example be made directly between the ends. This connection can also be made indirectly. In this case, the ends of the protuberances of a given group are all connected to a central element.

In particular, a conformation in which these protuberances extend radially with equal spacing between the protuberances is possible. This conformation has the advantage of favoring uniform product distribution around the applicator body.

Each group could have a star configuration.

Alternatively, the groups of protuberances could have a conformation other than a star conformation. This increases the choice of configurations that can be given to the applicator.

Preferably, the body comprises stacked discs.

This is a convenient way of making the applicator body. These discs can be connected together by different known means. They can for example be bonded, welded, or nested. Each disc may for example have one or more reliefs on one side and one or more cavities on its other side. The relief(s) of the disc fit into the cavity(ies) of an adjacent disc.

Advantageously, the groups extend between the discs.

Preferably, the body has cells for receiving the protuberances, at least some of the cells having a free volume for receiving product when the protuberance is in the retracted position in the cell.

By choosing the volume of the cells, the free volume is therefore chosen, such that these cells receive more or less large quantities of cosmetic product. For example, in order to increase the quantity of product loaded into the cell, its free volume can be increased, and inversely in order to decrease the quantity, or even make it zero.

For example, the discs forming the body could have opposite faces arranged such that the stack of these discs forms cells for housing the groups of protuberances.

Advantageously the applicator is arranged such that the free volume extends around the protuberance.

The applicator could be arranged such that at least some of the protuberances are in a non-rectilinear conformation in the retracted position.

For example, at least some of the protuberances can be in a bent or "S-shaped" conformation. The non-rectilinear conformation in the retracted position reduces the size.

Preferably, at least some of the protuberances have a bead.

This bead may in particular be present on a median portion of the protuberance. It allows the protuberance to carry a larger quantity of product above the bead when the protuberance moves from the retracted position to the extended position. Moreover, in the presence of the cells, it is preferably present on the portion of the protuberance located inside the cell in the retracted position. It therefore defines a free volume of the cell for receiving product when the protuberance is in the retracted position in the cell. The volume of the cells and the position of the bead on the protuberance are characteristics which can be used to predetermine the quantity of cosmetic product to be loaded on the protuberance. For example, in order to load only a small part of the protuberance with mascara, and therefore load only a small quantity of product, the bead can be positioned near its free end in order to reduce the free volume and, inversely to load a larger quantity of mascara. Furthermore, the bead can act as guide for the protuberance inside the cell by pressing against the inside of the cell.

At least some of the protuberances could occupy diametrically opposed positions on each side of the axis.

The invention also provides for a cosmetic product article comprising an applicator according to the invention.

Preferably, the article comprises a case, the applicator being fastened to the case but movable relative to the case between a retracted position and an extended position in which the applicator extends outward from the case further than in the retracted position.

Thus, the article is "pen" type, i.e. the applicator and the container are not separated during use. This embodiment has the advantage of simplifying use by the user who can have one free hand.

In one embodiment, the article is arranged such that the applicator moves from the retracted position to the extended position along a path parallel to a longitudinal direction of the article.

Advantageously, the article comprises a member for making the applicator move from the retracted position to the extended position and for making the protuberances move from the retracted position to the extended position.

Advantageously, the member is arranged to make the protuberances move from the retracted position to the extended position only after the applicator has moved from the retracted position to the extended position.

Thus, the dimensions of a case outlet orifice for the applicator and the overall volume of the article can be reduced. This also allows the quantity of mascara which is picked up by the brush to be controlled more easily.

Preferably, the article comprises a cosmetic product container.

Advantageously, the article comprises means for applying product on the applicator when the applicator is inside the case.

This avoids exposing the content of the container directly to the ambient air, so that the product in the container dries less.

Also preferably, the article comprises means for applying product on the applicator when the protuberances are in the retracted position.

Thus, the quantity of product delivered on the protuberances is reduced and it is easier to reduce this quantity to the precise quantity required to obtain a good make-up result, without wasting product.

Such a container may for example be a container comprising:

- an outer wall,
- an inner wall extending between the outer wall and a main axis of the container, and
- cosmetic product, the product being situated exclusively on the side of a surface of the inner wall that faces the outer wall.

Other containers may be considered.

Preferably, the cosmetic product is mascara.

BRIEF DESCRIPTION OF THE DRAWINGS

Other characteristics and advantages of the invention will appear on reading the description of an embodiment given as a non-limiting example, and referring to the drawings in which:

FIGS. 11A, 11B and 110 show the article in respective positions in which the applicator extends fully into the case and the bristles are retracted, the applicator extends outward from the case and the bristles are retracted, and the applicator extends outward from the case and some of the bristles protrude outward from the applicator body.

DETAILED DESCRIPTION OF THE INVENTION

Figure 1:
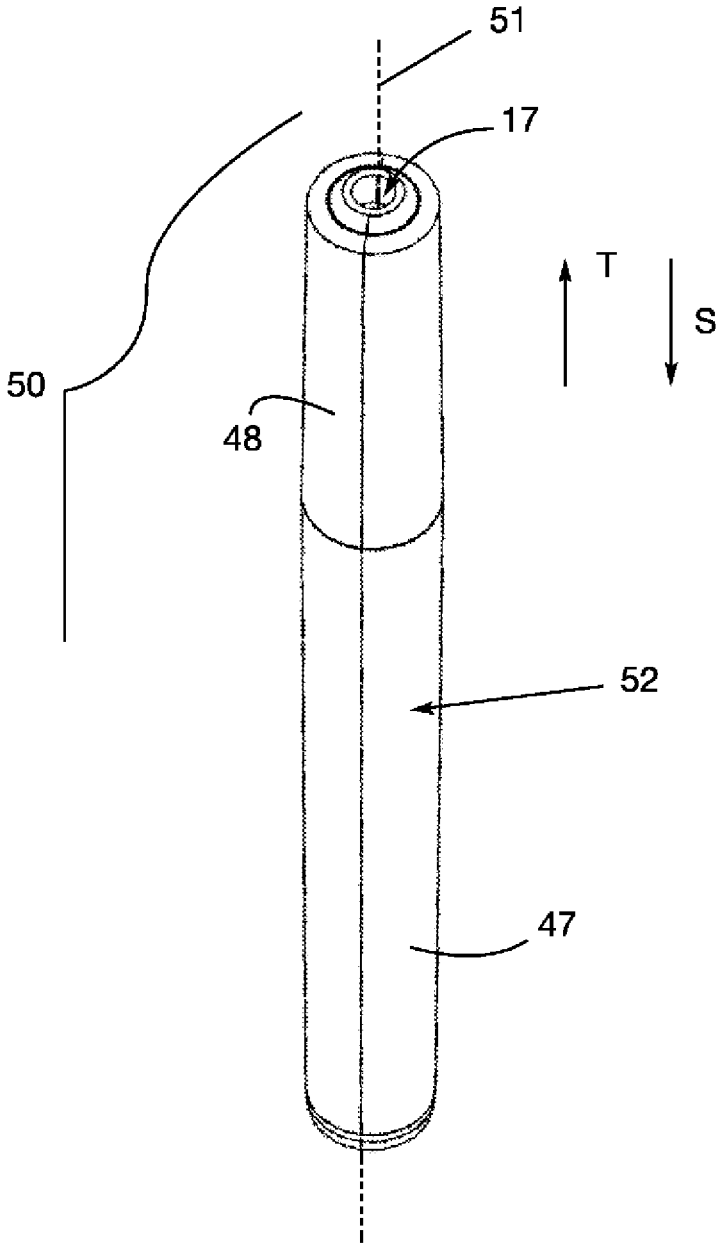
FIG. 1 is a perspective view of a cosmetic product article according to one embodiment of the invention.

We will now describe an embodiment of the article 50 according to the invention, in reference to FIGS. 1 to 12C. The cosmetic product is in this case mascara for eyelash make-up.

Article 50 comprises a "pen-type" case. It has a generally elongated shape of axis 51 which is symmetrical about this axis. The case has an outer face 52 of generally cylindrical shape with a circular cross-section in a plane perpendicular to the axis 51.

The case externally comprises two parts 47, 48 mounted movable in rotation relative to each other coaxially about the axis 51. In the remainder of the document, and for convenience, part 48 will be designated as the fixed part and part 47 as the movable part.

FIGS. 2A to 2D show the mascara applicator 11 of the article. In this case, it is a brush.

The brush comprises a body 1 having an outer face of cylindrical shape with a circular cross-section in a plane perpendicular to the axis 51. The body comprises an elongated support 1 and discs 2, identical to each other and stacked coaxially with the support to extend it at one end of the support. In this case, there are 26 discs 2, this number not being limited of course. The body also comprises a cap 5 terminating the stack of discs at one end thereof opposite the support. The outer face of the body is therefore formed by that of the support 1, the discs 2 and the cap 5.

The brush comprises protuberances which are in this case soft bristles 3. Relatively rigid teeth or pins could also be used, however.

The brush may have a configuration in which the bristles 3 extend entirely inside the body 1 without protruding from its outer face and a configuration in which the bristles protrude from this face.

Figure 4A:
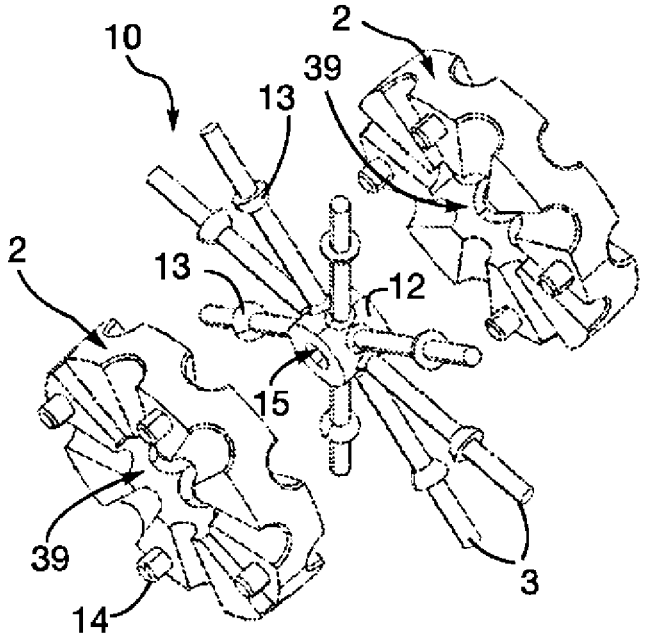
FIG. 4A is an exploded view of a stage of the applicator.
Figure 4B:
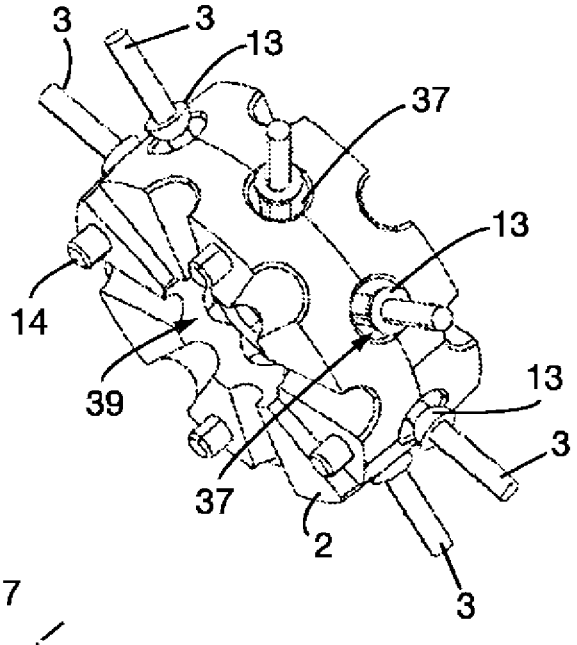
FIGS. 4B and 4C are views of this stage respectively in a conformation with the bristles protruding outward from the applicator body and retracted in the body.
Figure 4C:
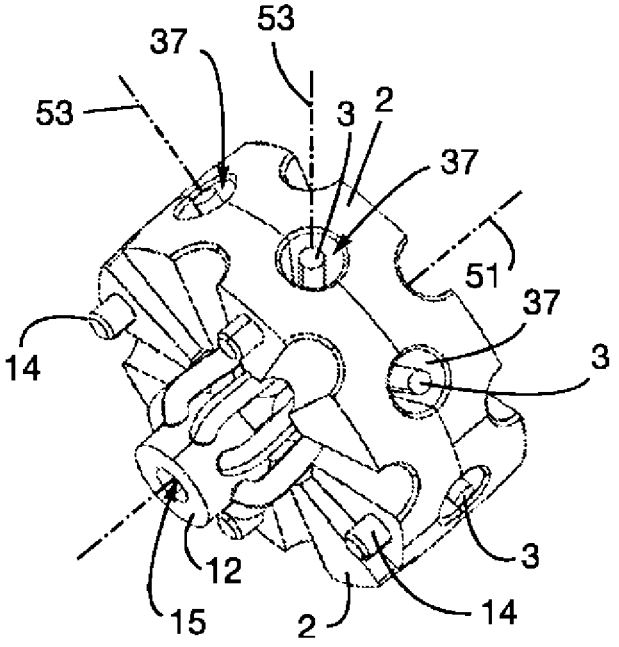
Figure 5A:
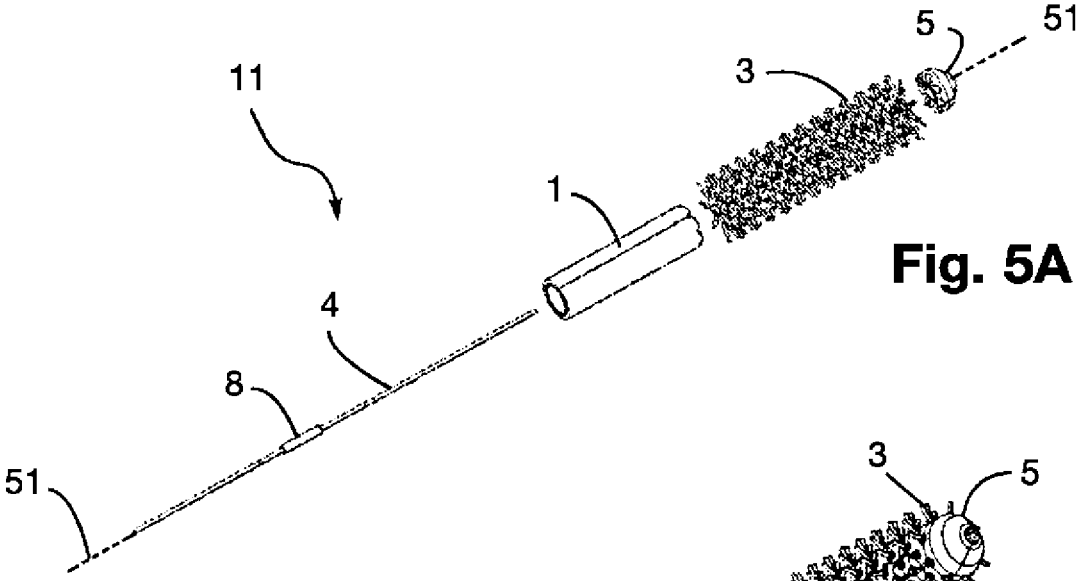
FIG. 5A is an exploded view of the applicator.
Figure 5B:
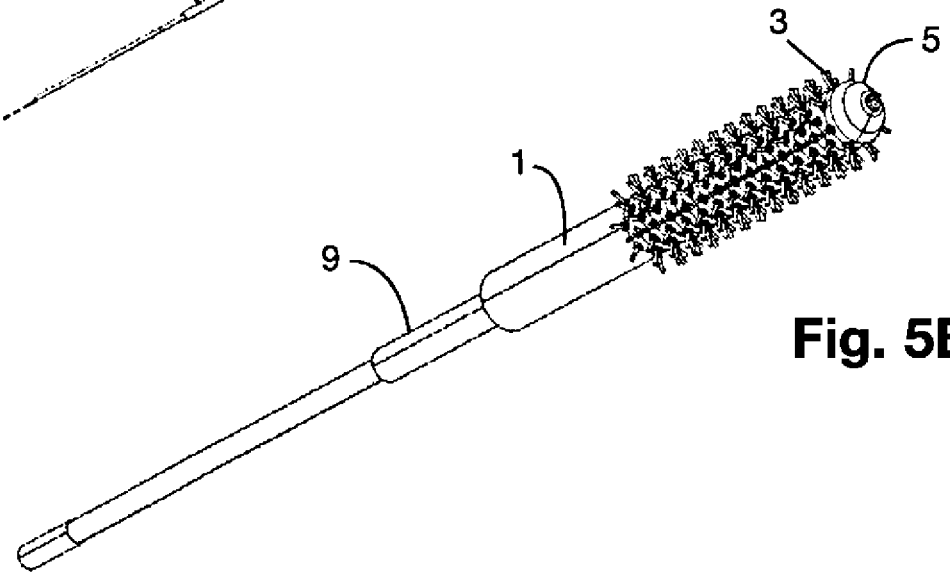
FIGS. 5B and 5C are perspective views of the applicator and of an inner part of the article.
Figure 5C:
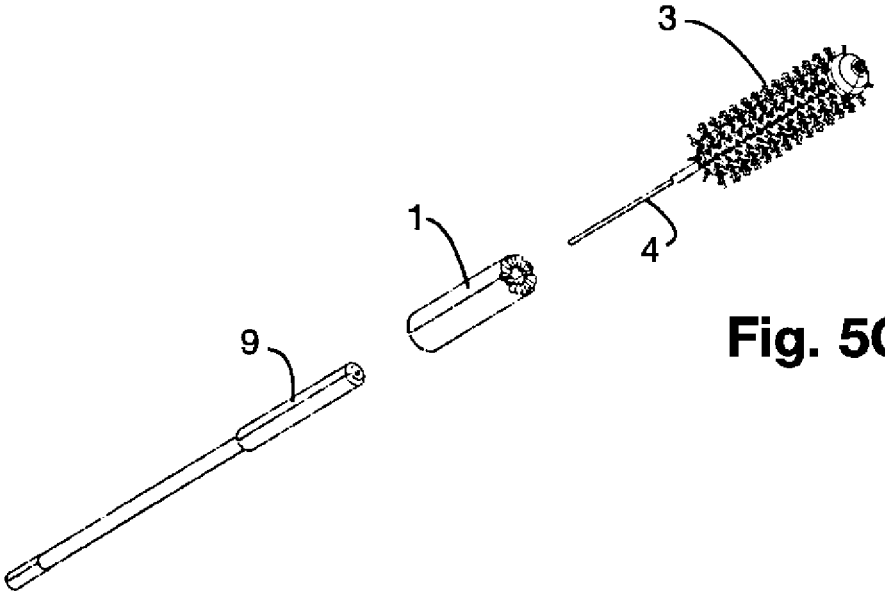
Figure 6:
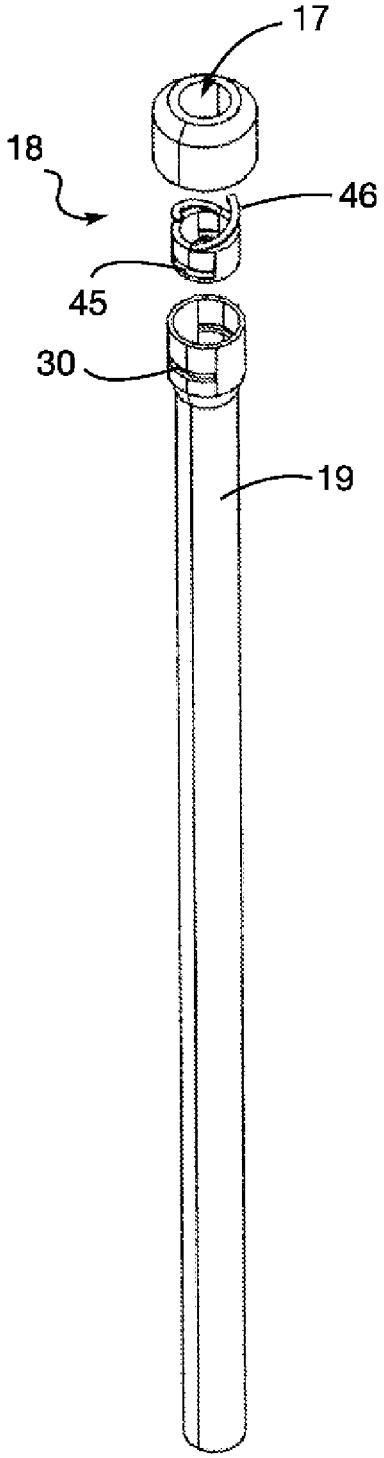
FIG. 6 shows an inner tube and a valve as well an outlet nozzle of the article.

FIG. 4A to 4C show in detail a section of the applicator at any two consecutive discs 2.

The discs 2 are fitted into each other. Each disc therefore comprises on one of its faces studs 14, in this case four studs and on its opposite face the same number of cavities, for receiving the respective studs of the adjacent disc following it in the series. The discs are thus precisely positioned and fixed relative to each other and prevented from turning relative to each other about the axis or from sliding relative to each other in a direction perpendicular to this axis. The stacked discs may be linked by various means. In this case, the discs are bonded to each other by their faces in contact. The same applies for the cap 5 which is bonded to the last disc of the stack and for the support 1 which is bonded to the first disc of the stack. This therefore creates a rigid assembly forming the body.

The discs 2 are configured such that two adjacent discs define at their interface cells 37, eight in this case. Each cell has in this case a frustoconical shape having an axis 53 oriented perpendicular to the main axis 51. The wider cross-section of the cone frustum is located at the outer face of the body. Each cell 37 has a circular cross-section in a plane perpendicular to its axis 53. The cells are arranged radially about the axis 51 and are distributed regularly about this axis. Half of each cell is formed by one of the discs and the other half by the other disc. Each face of one of the discs therefore has radial half-frustum-shaped recesses.

To avoid weakening the discs, the recesses of one of the faces of each disc are offset angularly about the axis 51 relative to those of the other face. Otherwise, in fact, the disc thickness would be highly reduced at the bottom of the recesses. The term "crown" designates the groups of cells extending in a given plane perpendicular to the axis 51. The angular offset of the recesses of each disc determines that of the cells in two consecutive cell crowns. Given the number of cells in each crown, this offset is in this case one 16th of a revolution.

The discs have a recess 39 in their centers into which the cells 37 open out.

In this embodiment, each cell 37 receives one and only one bristle 3 such that there are equal numbers of bristles and cells. Thus, like the cells 37, the bristles 3 form crowns comprising eight bristles associated with a given plane perpendicular to the axis 51.

We see that the bristles extend all around the axis 51, some being diametrically opposed each side of the axis. The bristles form rows parallel to the axis. The rows are regularly distributed about the axis and the bristles are regularly spaced in each row.

In this embodiment, the relief of each bristle has the shape of a bead 13, as shown in particular on FIG. 4A. In this case, the bead has a flat face on the side of the bead directed towards the free end of the bristle. The bead extends in a median portion of the bristle and is therefore at a distance from each of its ends.

In this example, the bristles 3 of each crown form a group in which the bristles are attached to each other, in this case by an inner end of the bristles. The group is thus given a star-configuration shown in particular on FIG. 4A. As shown on FIGS. 4A to 4C, a group of bristles of this type is interposed between two consecutive discs such that the bristles are housed in the respective cells.

The bristles can be made of any material generally used to manufacture mascara applicator brushes. The bristles of a given group of protuberances can be made of different materials. In addition, the bristles located at different stages do not necessarily have the same composition. A given bristle can also be made of different materials. For example, a bristle may be bi-material and thus have a center of one particular material and an outer wall of another material. The bristles are not necessarily made of plastic. For example, the bristles may be made of a natural material such as natural fibers.

Each group of bristles comprises a central ring 12 to which the bristles are attached. The article comprises a straight rod 4, forming an actuator. The ring 12 has an opening 15 at its center thereby allowing the actuator 4 to go through each ring. All the rings are thus threaded on the actuator and are in abutment against each other along the direction of the axis. Thus, the central part 12 of a group of bristles 10 of a given stage of the applicator is in contact with the central part of the group of bristles of the higher and/or lower stage, such that the protuberances are in the retracted or protruding position as will be seen below. The actuator 4 comprises at its free end a member 40 for axially blocking the rings on the actuator.

The actuator 4 is slidably mounted in the body 1 along the direction of the axis 51 such that the bristles of the applicator can move from a retracted position to an extended position and vice versa. The actuator 4 comprises an overthickness 8 and the support 1 a shoulder 41 adapted to cooperate with this overthickness to determine the limit of the actuator movement stroke in the body associated with the retracted position. An arrangement is further provided to limit the stroke of the actuator in the other direction.

Figure 2A:
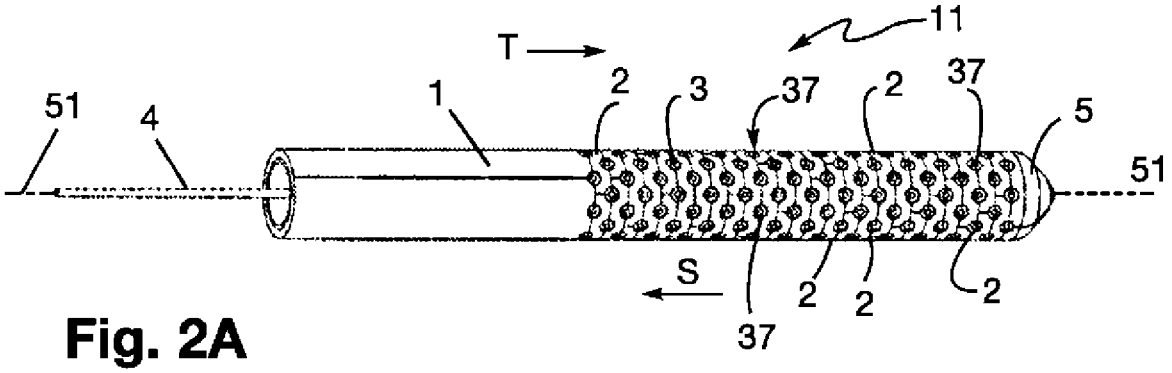
FIGS. 2A and 2B are perspective views of the applicator of the article of FIG. 1, respectively in a configuration with the bristles retracted in the applicator body and protruding outward from the body.
Figure 2B:
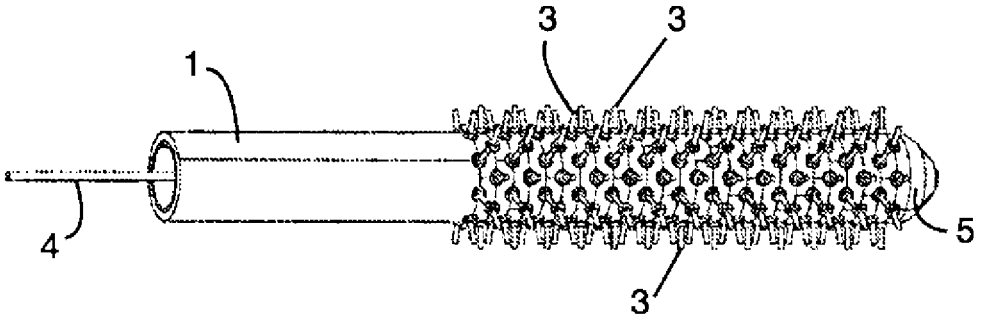
Figure 3A:
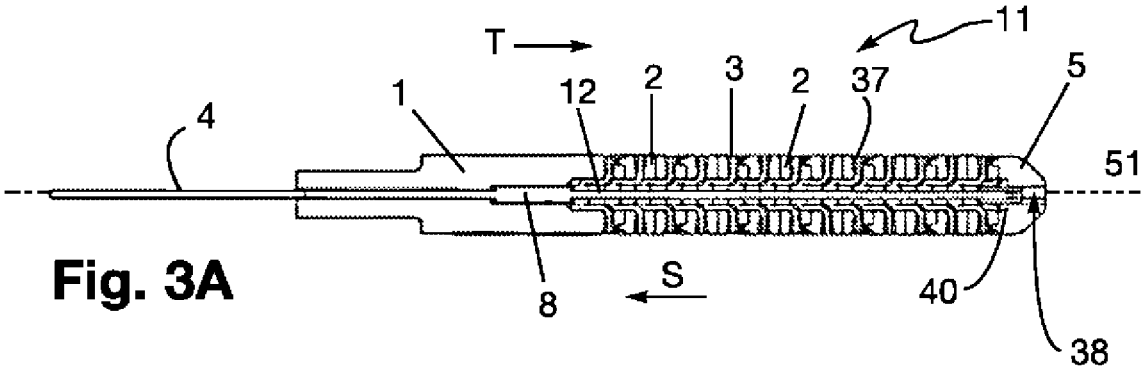
FIGS. 3A and 3B are axial cross-sectional views of the applicator of FIGS. 2A and 2B.
Figure 3B:
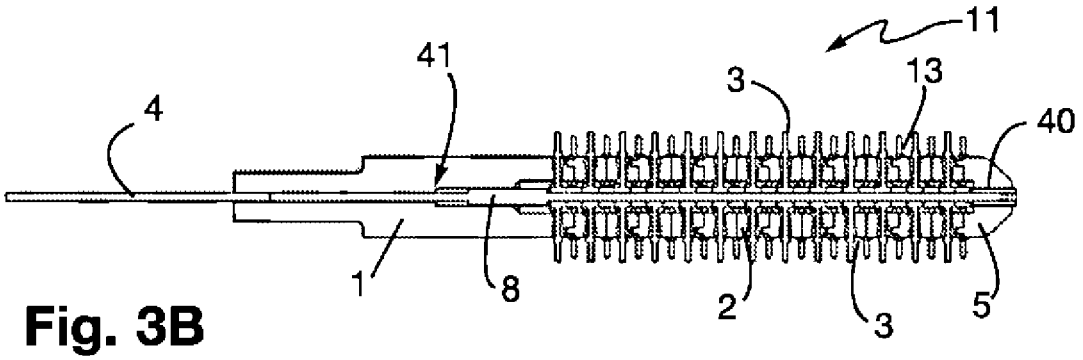

In the retracted position, shown in particular on FIGS. 2A and 3A, the bristles extend fully into the body 1. In the extended position shown in particular on FIGS. 2B and 3B, the bristles 3 protrude outward from the body with reference to the direction radial to the axis 51, over most of the length of each bristle. We therefore see that the applicator is arranged such that each free end of a bristle follows a path transverse or perpendicular to the longitudinal axis 51 of the applicator from the retracted position to the extended position.

To move the bristles from the retracted position to the extended position, the actuator 4 undergoes a linear translation along its longitudinal axis in the direction T shown on FIG. 1. To make the opposite change, it undergoes a linear translation along its longitudinal axis in the direction S.

In the retracted position, the bead 13 is clearly set back from the outer face of the body, in the latter. The free end of the bristle is in this embodiment flush with this face. A generally sleeve-shaped free volume is therefore created in the cell above the bead and around the bristle. This free volume is intended to be loaded with make-up product as will be seen below.

In the extended position, illustrated for example on FIG. 4B, the bead protrudes from the face of the body. The volume of make-up product which filled the volume of the cell above the bead has therefore been removed completed and is now completely outside the body. In the extended position, the bristles of each group are located entirely in the same plane perpendicular to the axis 51, as illustrated on FIG. 4A. The end of the actuator is thus housed in a central recess 38 of the cap.

In the retracted position, the bristles have an "S-shape" with two bends. This offers the advantage that the bristles do not need to come out of their cells when in the retracted position and that the space required to store the applicator in the case is reduced. To this end, the central space of the discs is designed to be large enough to receive the inner end portions of the bristles which lie parallel to the axis 51.

We will now describe the mechanism for controlling the output of the bristles 3 from the body 1 of the brush 11 and the output of the brush from the case. This mechanism comprises a control sub-assembly 36. The latter comprises in particular a guide 20, a pusher 25, a spring 27, an input/output barrel for the brush 26 and a needle 9.

We have seen that the distal end section of the actuator 4 was rigidly connected to the bristles. The other proximal end of the actuator is rigidly fastened to a distal end of a central straight needle 9 of the control sub-assembly 36, as illustrated on FIG. 5C in particular.

Figure 10:
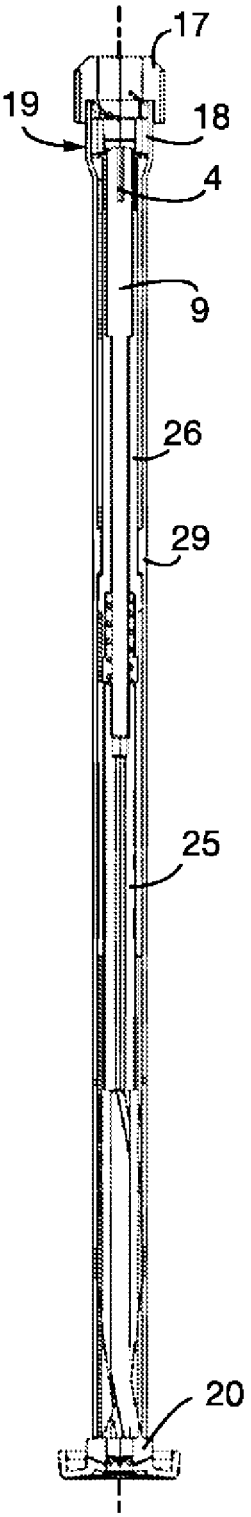
FIG. 10 shows an axial cross-sectional view of the tube in which the control sub-assembly is positioned.

The needle 9 is rigidly connected by its proximal end to the distal end of a hollow cylindrical pusher 25 as shown on FIG. 10. This connection can for example be made by screwing.

This therefore forms an assembly of several parts, i.e. the pusher 25, the needle 9 and the actuator 4, rigidly connected together and all sliding along the axis 51 relative to the case.

The sub-assembly further comprises a barrel 26 formed by a hollow generally cylindrical part slidably mounted along the axis 51 firstly relative to the case, secondly relative to the needle 9 on which it is threaded.

A spring 27 is inserted in the axial direction between the barrel 26 and the pusher 25 and threaded on the needle 9. It is in abutment at its distal end against a shoulder of a proximal end of the barrel 26 and at its proximal end against the distal end of the pusher 25.

The mechanism also comprises a guide 20 also formed by a hollow part of generally cylindrical shape. This part is open at its distal end. It is also open so as to have two elongated side slots 54 parallel to the axis 51 and extending opposite each other. This part is rigidly fastened to the movable part 47 of the case. Consequently, when the part 47 is operated, the guide 20 is operated.

The pusher 25 comprises at its proximal end two reliefs 35 adapted to be received in the slots 54 of the guide and to slide in the slots to guide the pusher relative to the guide.

Figure 9:
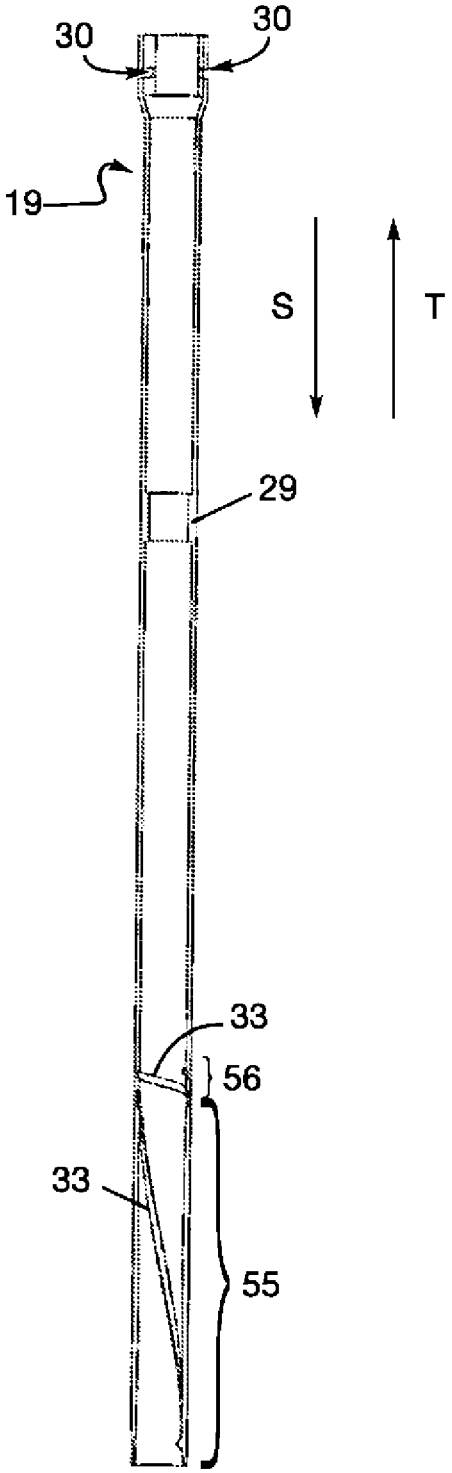
FIG. 9 shows an axial cross-sectional view of an inner tube of the article.

This control sub-assembly is arranged inside a tube 19 as shown on FIGS. 9 and 10. The tube, shown on FIG. 9, is a cylindrical tube whose proximal end is located at the guide 20 and whose distal end at a distal end of the case has an orifice 17 for the applicator to come out.

On the inner side of its portion located near the guide, the tube 19 has a double helical thread 33 forming a groove on the inside of the tube. The thread has two successive sections 55, 56 along the axis 51 with two different pitches. The first section starting from the proximal end of the tube thus has a first pitch and the second a second pitch smaller than the first pitch. The reliefs 35 of the pusher have a stud 42 that protrudes from their surface. These studs are adapted to cross the two successive sections 55, 56 of the double thread 33 of the tube 19.

The tube 19 has in a median portion of the tube an internal annular relief 29 forming an abutment for the proximal end 38 of the barrel 26.

The tube 19 has at least one opening, and preferably two radial openings 30 being located at its distal end near the output orifice 17. The two openings are diametrically opposite one another on either side of the axis.

The distal end portion of the tube has a flared cross-section larger than its cross-section in the rest of the tube. This larger cross-section allows a valve 18 to be fitted.

Figure 11A:
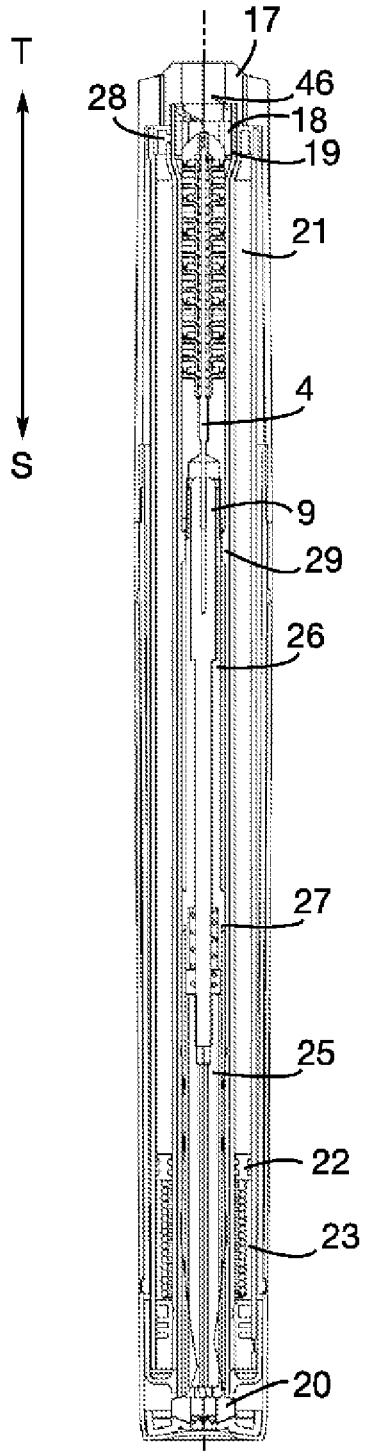
Figure 11B:
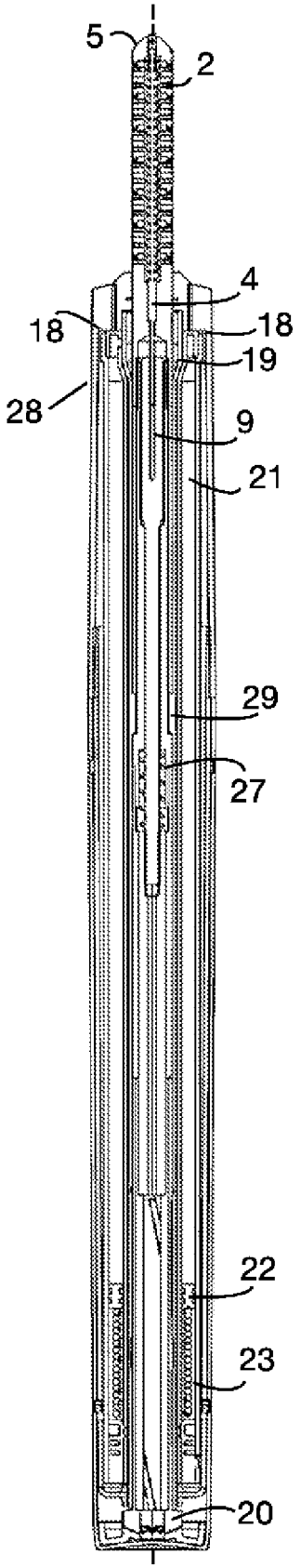
Figure 11C:
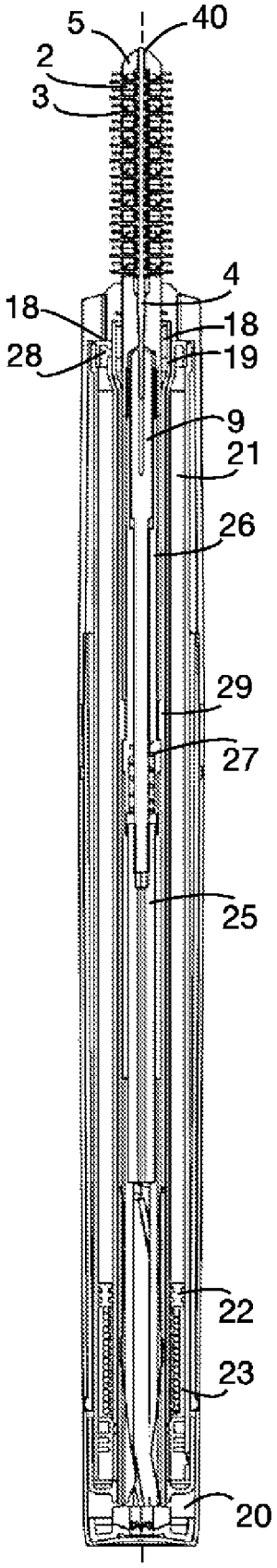
Figure 12A:
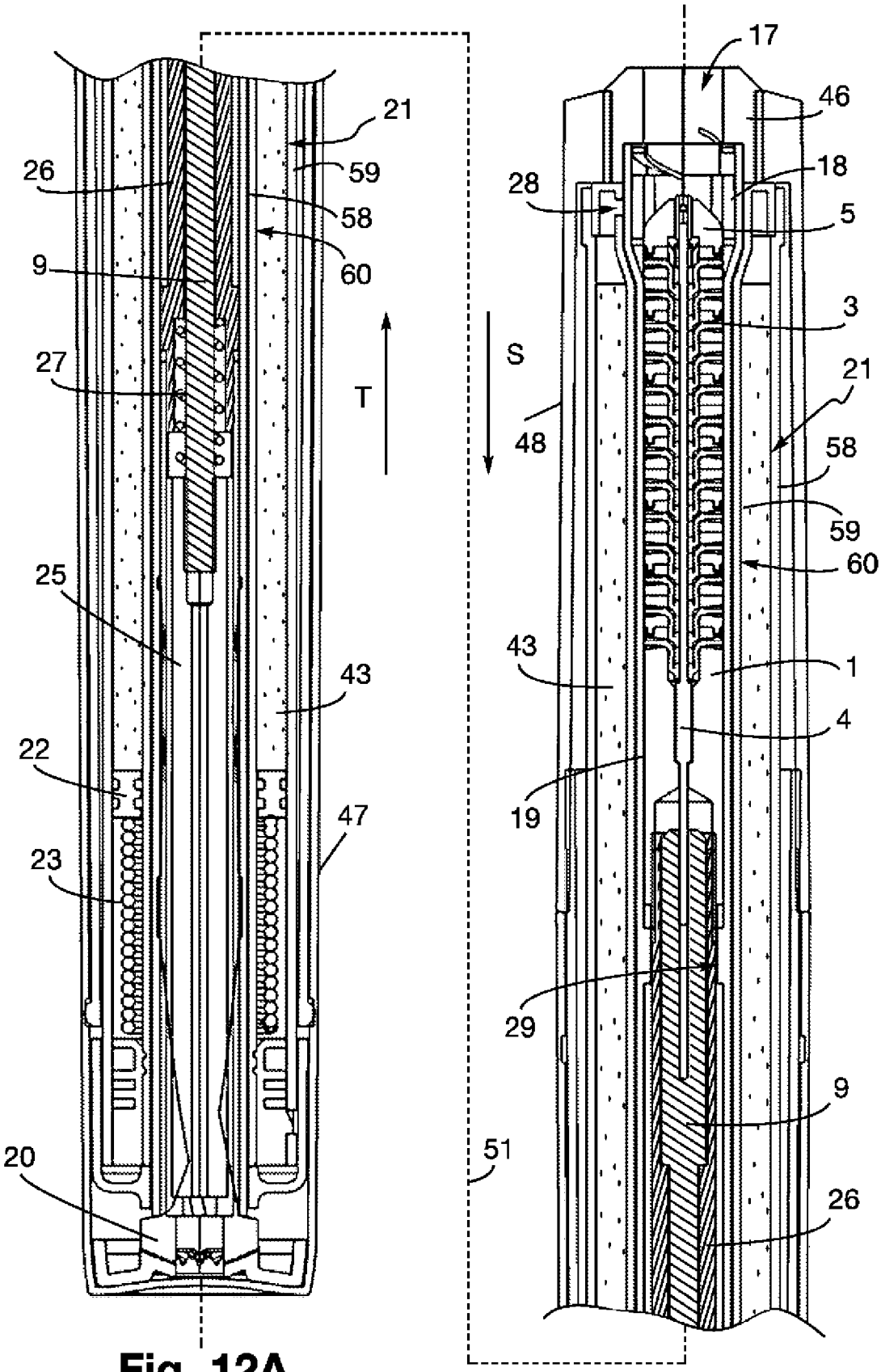
FIGS. 12A, 12B and 12C show the applicator of the previous figures at a larger scale.
Figure 12B:
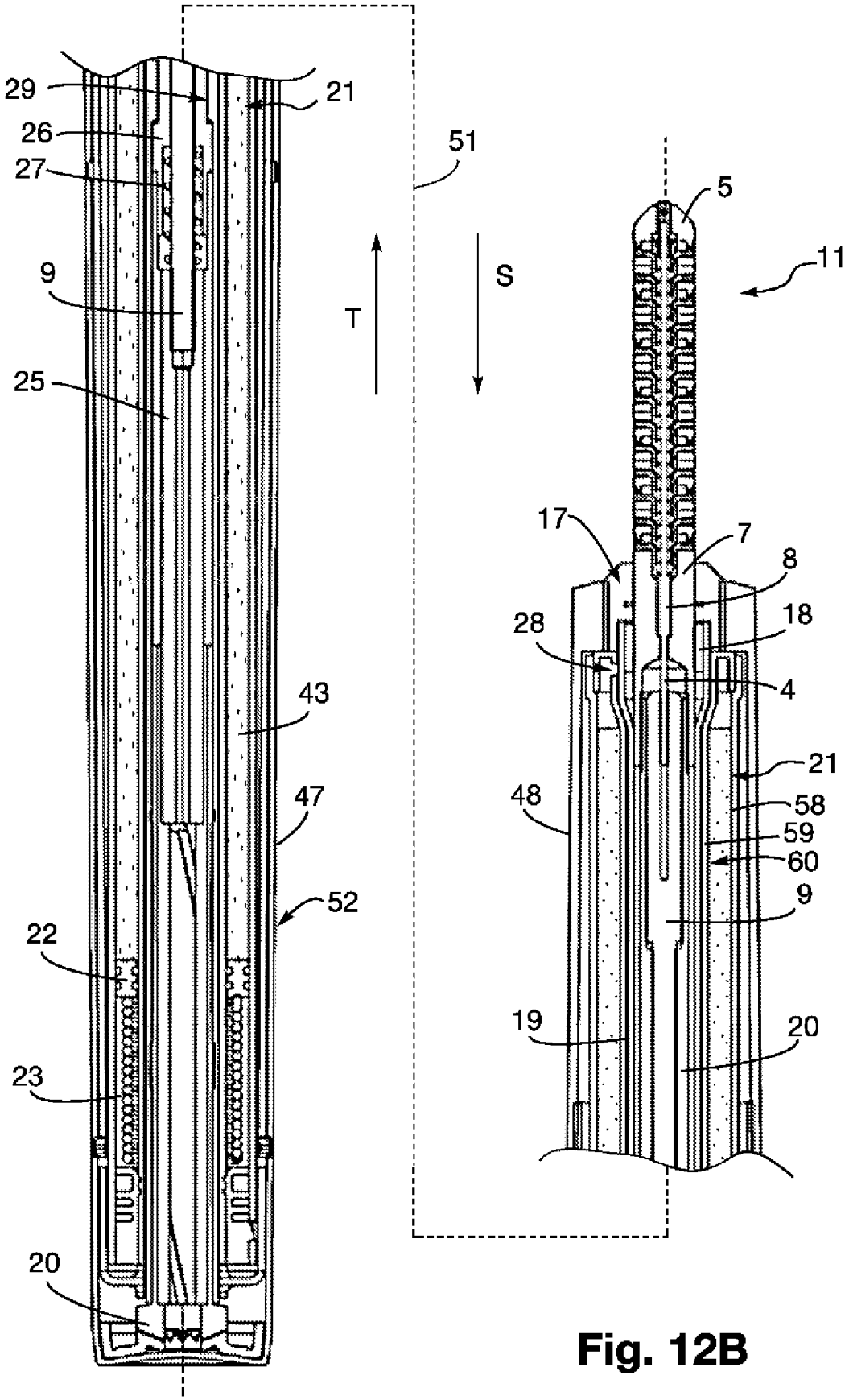
Figure 12C:
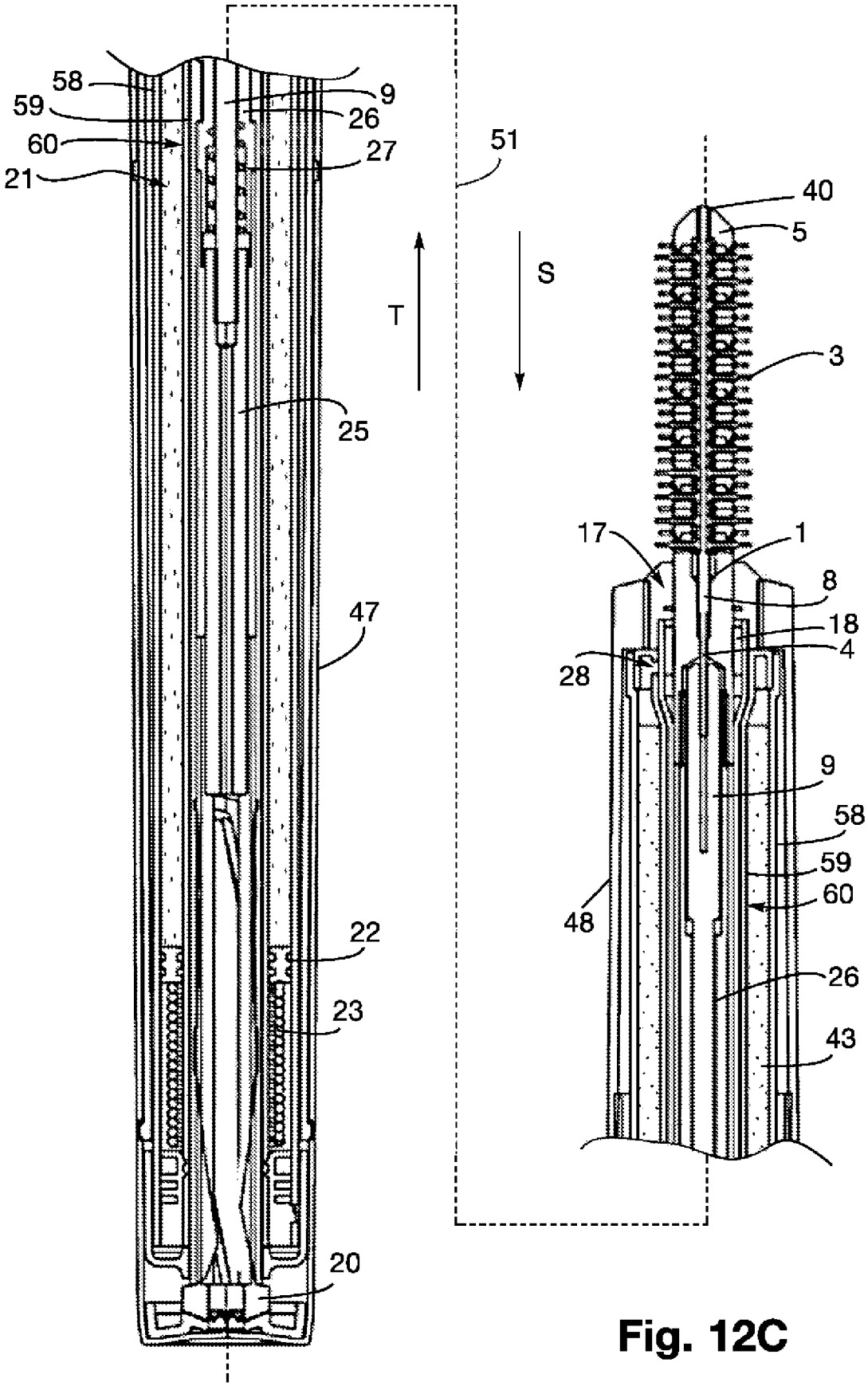

As shown on FIGS. 11 A to 12C, the tube 19 is arranged in the case.

The annular peripheral space remaining around the tube is occupied by a mascara container 21.

The mascara container 21 or cartridge thus has the shape of a cylindrical sleeve with a circular annular cross-section. It comprises an outer wall 58 and an inner wall 59 which are coaxial. The mascara 43 is situated exclusively between these two walls and the side of the outer face 60 of the inner wall. This side is opposite the inner face of the outer wall, when there is no product in the container. The container is rigidly fastened to the fixed part 48 of the case.

As will be seen, the brush 11 is not in contact with the product 43 in the container and does not extend into the latter when the brush is not used.

In this case, the container 21 has two openings 28 located at the distal end of the container which is close to the output orifice 17. These openings are aligned with the two similar openings 30 of the inner tube. These openings are directed radially towards the axis 51.

The mascara can come out of the container in several ways. In this case, the mascara is kept under pressure inside the container such that, when at least one opening of the container is opened, this pressure makes the mascara come out through this opening.

In this case, as shown on FIGS. 11A to 13, the mascara is kept under pressure in the container by a piston 22 and spring 23 mechanism. The spring and piston have an annular shape similar to that of the container in which they are housed. The piston 22 is in contact with the container walls. It can slide inside the container along the direction of the axis 51. The spring 23 presses at its distal end against the piston and at its proximal end against a plug positioned against the proximal end of the container. As the container is emptied of mascara, the piston moves toward the distal end of the container under the effect of the spring.

Figure 7:
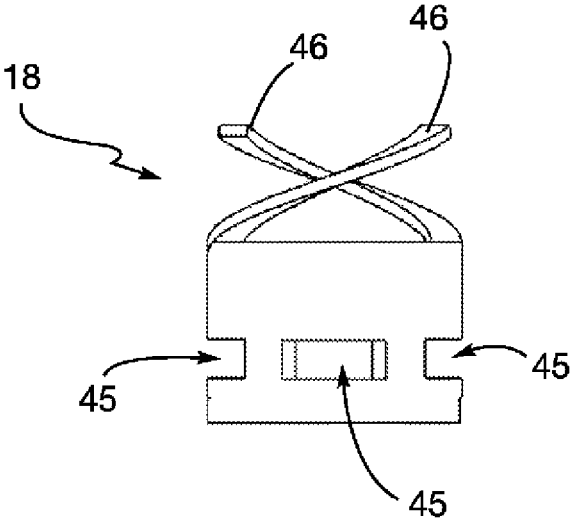
FIG. 7 is an elevation view of the valve.
Figure 8:
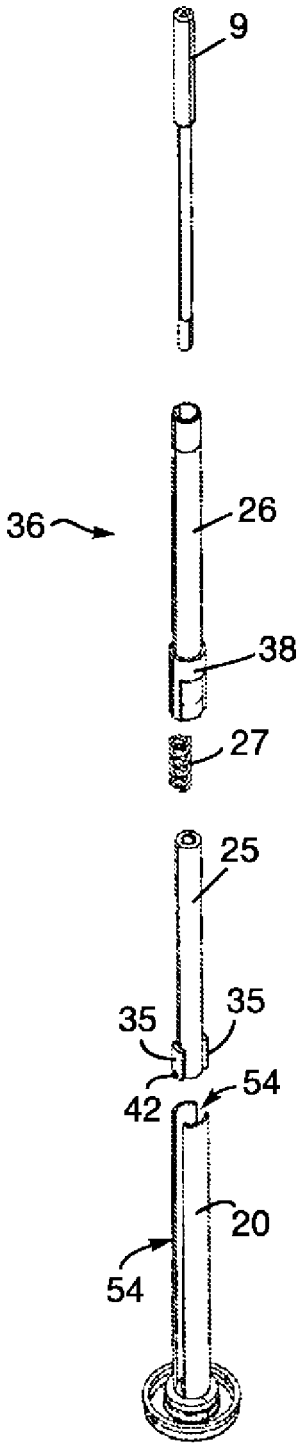
FIG. 8 shows an exploded view of a sub-assembly for controlling the movement of the applicator entering and leaving the case as well as the movement of the bristles entering and leaving the applicator.

The device further comprises a valve 18, shown in particular on FIG. 7. This valve has a generally cylindrical shape and has at least one radial opening 45 located at its side wall, and preferably several. It is slidably mounted relative to the tube 19, and housed in its flared section. The valve has a cylindrical housing of axis 51 at its center, adapted to be crossed by the brush 11.

The valve can move from a proximal position to a distal position. The proximal position of the valve 18 is a closed position in which the valve openings 45 are not aligned with those of the container 21 and of the tube 19. The distal position is an open position in which the valve openings are aligned with those of the container and of the tube.

The valve has one or more helical spring leaves 46 of axis 51 to return the valve into the proximal position. The leaves have a proximal end fastened to the distal face of the valve body and a free distal end pressing axially against the edge of the orifice 17. These leaves therefore stop the distribution of mascara from the container once the mascara applicator is out of the case.

The valve slides from the closed position to the open position by friction under the action of a movement of the brush to make the brush come out of the case. Sliding in the opposite direction takes place under the effect of the return leaves.

The applicator operates as follows.

It is assumed that the article is in the configuration of FIGS. 1 and 11A, the brush 11 being located entirely inside the case, in the retracted position, its bristles 3 being entirely inside the body 1, therefore in the retracted position.

The movable portion 47, and therefore the guide 20, is rotated relative to the fixed part 48 about the axis 51.

The studs 42 of the reliefs 35 for guiding the pusher then run in the first proximal section of the thread 33 of the tube 19. Since these reliefs are blocked in rotation in the slots 54 of the guide 20, the pusher 25 slides along the direction of the axis 51 in the direction T.

As it slides, the pusher 25 entrains with it, under the effect of the spring 27, the barrel 26, the needle 9, the actuator 4 and the brush 11. This sliding makes the applicator come out of the case body, as shown on FIG. 11B. All the brush discs are now outside the case. Sliding continues until the proximal end 38 of the barrel 26 comes into axial abutment against the shoulder 29 of the tube 19.

During the movement before the applicator comes out, the brush 11 entrains by friction the sliding of the valve 18 in contact with the body of the brush going trough the valve which therefore moves from the closed position to the open position. This therefore aligns the openings 28, 30, 45 of the container 21, the tube 19 and the valve 18.

Under the effect of the pressure exerted by the spring-piston mechanism, the mascara comes out of the container through its two openings 28, goes through the tube and valve and spreads in the free volumes of some of the cells 37 of the brush. These are the cells which are exposed to the flows of product when the brush moves in front of the openings. The other cells are not loaded with product.

After the abutment, knowing that the user continues to rotate the movable part of the case, the pusher 25 continues to slide in the direction T, the studs 42 of the reliefs 35 for guiding the pusher now running through the second distal section of the thread of the tube 19. This sliding therefore occurs while compressing the spring 27. The pusher entrains the needle 9 and the actuator 4 along the axis, thus causing the bristles 3 to move from the retracted position inside the applicator body to the extended position, protruding outward from the applicator body as shown on FIG. 110.

During this operation, note that the spring 27 is not compressed during the first part of the movement, i.e. until the barrel 26 abuts against the shoulder 29 of the tube. This first part of the movement corresponds to the part where the studs of the reliefs run through the first part of the thread 33 of the tube (the part with the larger pitch). This first part of the movement corresponds to the brush coming out of the applicator body.

The spring 27 is then compressed in the second part of the movement which occurs as the studs of the reliefs run in the second section of the thread 33 of the tube such that the applicator bristles can come out of the applicator body.

As the bristles come out, the bristles associated with the cells loaded with product carry with their beads the mascara initially loaded in the cells. It is therefore the free end portions of the bristles which are loaded with mascara, not their complete lengths. In particular, the part of the brush extending between the bead and the brush body is not loaded with mascara or is loaded with a very small quantity. The brush is therefore loaded with the precise quantity of mascara required for the make-up.

In this embodiment, the openings of the tube 19 and those of the container extend around only part of their circumferences. This means that only some of the cells 37 are loaded with mascara as the brush passes, some of the cells not being loaded at this time. This represents a preferred embodiment of the invention. Thus, the bristles that are not loaded with mascara can spread the mascara that was deposited on the eyelashes by the bristles which were loaded with mascara. The bristles not initially loaded with mascara spread the mascara more efficiently along the eyelashes. When making up the eyelashes, mascara is transferred from the bristles initially loaded to the eyelashes, and also to the bristles not initially loaded, then from them to the eyelashes. Normally, only a minimum quantity of mascara remains on the brush after make-up.

In particular, we observe that the brush is loaded with mascara before it completely comes out of the case and also before the bristles come out of the brush body. Each of these characteristics has its own advantages. Loading the brush before it comes out of the case prevents the product in the container from coming directly into contact with ambient air, which reduces the risks of drying. Loading the brush in the cells before the bristles come out reduces the quantity of product to be deposited on the brush.

The quantity of mascara which will be loaded on the brush largely depends on the free volume of the cells and therefore on the configuration of the brush and of the bristles.

Obviously, numerous modifications can be made without leaving the scope of the invention.

The case configuration could for instance be modified. For example, the invention could be implemented with a case comprising a removable cap. In this case, the applicator could be permanently attached to the cap.

The container could be removable, in other words it can be easily taken out of the case when the container is empty to replace it by a full container or reload it with product.

Each ring of cells could comprise a different number of cells than that described above. The same could apply for each group of bristles.

The applicator will not necessarily be a brush. It may be a comb.

Many characteristics of the article can be implemented independently of each other. In particular, the following three aspects could be implemented independently of each other:

- the movable assembly of the applicator protuberances between a retracted position and an extended position in which they extend outward from the applicator body further than in the retracted position,
- the container configuration with outer and inner walls, in which the product is situated exclusively on the side of a surface of the inner wall that faces the outer wall, and
- the movable assembly of the applicator relative to the case between a retracted position and an extended position in which it extends outward from the case further than in the retracted position.

In a particular embodiment, the article can easily be dismantled to replace the brush by another brush. This characteristic is especially advantageous since it allows users to make substantial savings by not having the buy the complete article when the brush is worn out.

The presence of the valve is optional. Indeed, product distribution can be stopped by giving the inside of the article a suitable shape.

The invention claimed is:

1. An applicator for applying an eyelash cosmetic comprising:

a body, and protuberances having a free end, an internal end and a median portion between the free end and the internal end, the protuberances being arranged so as to be movably mounted relative to the body between a retracted position and an extended position, in which the protuberances extend outward from the body further than in the retracted position, at least some of the protuberances having a bead which is present on the median portion and spaced from the free and internal ends, the applicator being arranged such that each free end follows a path transverse to a longitudinal axis of the applicator from the retracted position to the extended position.

2. The applicator according to the claim 1, arranged such that all the protuberances extend fully into the body in the retracted position.

3. The applicator according to claim 1, wherein the protuberances form groups of protuberances extending in a given plane perpendicular to the longitudinal axis, the protuberances of each group being connected together by an internal end of the protuberances in the body.

4. The applicator according to claim 3, wherein each group has a star configuration.

5. The applicator according to claim 4, wherein the body comprises stacked discs.

6. The applicator according to claim 5 wherein the groups extend between the stacked discs.

7. The applicator according to claim 3, wherein the body comprises stacked discs and the groups extend between the stacked discs.

8. The applicator according to claim 1, wherein the body comprises stacked discs.

9. The applicator according to claim 8, wherein the groups extend between the stacked discs.

10. The applicator according to claim 1, wherein the body has cells for receiving the protuberances, at least some of the cells having a free volume for receiving product when the protuberance is in the retracted position in the cell.

11. The applicator according to claim 10, arranged such that the free volume extends around the protuberance.

12. The applicator according to claim 1, arranged such that at least some of the protuberances are in a non-rectilinear shape in the retracted position.

13. The applicator according to claim 1, wherein the bead is located at a distance from each of the free and the internal ends.

14. The applicator according to claim 1, wherein at least some of the protuberances occupy diametrically opposed positions on each side of the axis.

15. The applicator of claim 1 configured as part of a cosmetic product article.

16. The article according to claim 15, comprising a case, the applicator being fastened to the case but movable relative to the case between a retracted position and an extended position in which the applicator extends outward from the case further than in the retracted position.

17. The article according to claim 16, arranged such that the applicator moves from the retracted position to the extended position along a path parallel to a longitudinal direction of the article.

18. The article according to claim 16, comprising a member for making the applicator move from the retracted position to the extended position and for making the protuberances move from the retracted position to the extended position.

19. The article according to claim 16, comprising a cosmetic product container and means for applying product on the applicator when the applicator is inside the case.

20. The article according to claim 15, comprising a cosmetic product container which applies product on the applicator when the protuberances are in the retracted position.

* * * * *